United States Patent [19]

Columbus

[11] Patent Number: 4,835,818

[45] Date of Patent: Jun. 6, 1989

[54] DIFFERENTIAL GINNING PROCESS AND APPARATUS

[75] Inventor: Eugene P. Columbus, Leland, Miss.

[73] Assignee: The United States of America as represented by the Secretary of Agriculture, Washington, D.C.

[21] Appl. No.: 140,470

[22] Filed: Jan. 4, 1988

[51] Int. Cl.[4] ..... D01B 1/08

[52] U.S. Cl. ..... 19/55 R; 19/64.5

[58] Field of Search ..... 19/55 R, 59, 64.5, 57

[56] References Cited

U.S. PATENT DOCUMENTS

| | | | |
|---|---|---|---|
| 26,516 | 12/1859 | Olmstead . | |
| 106,613 | 8/1870 | Payne | 19/55 R |
| 202,927 | 4/1878 | Burt, Jr. . | |
| 1,118,412 | 11/1914 | Graves | 19/57 |
| 1,118,413 | 11/1914 | Graves | 19/57 |
| 1,827,183 | 10/1931 | Bennett | 19/59 |
| 1,862,884 | 6/1932 | Collier | 19/55 R |
| 2,744,293 | 5/1956 | Johnson | 19/59 |
| 3,320,640 | 5/1967 | Van Doorn | 19/64.5 |
| 4,433,454 | 2/1984 | Salmon et al. | 19/55 R |

OTHER PUBLICATIONS

Bennett, Charles A., "Saw and Toothed Cotton Ginning Developments", Printed by the Texas Cotton Ginner's Ass., Inc. P.O. Box 7665, Dallas 26, Tex., pp. 7–8.

Griffin, A. Clyde, Et Al, "Differential Ginning", The Cotton Gin and Oil Mill Press, Jun. 11, 1960.

Wilkes, L., Et Al, "A Selective Ginning Process for Cotton", Proc. Beltwide Cotton Prod. Res. Conf., C. T. Nelson Ed., Nat. Cotton Council, Memphis, TN, 1985, pp. 341–343.

Wilkes, L. H., Et Al., "Improved Fiber Properties . . . " Am. Soc. of Ag. Engineers, Paper No. 86–1084, Jun. 29–Jul. 2, 1986, 9 pages.

*Primary Examiner*—Werner H. Schroeder

*Assistant Examiner*—Sara M. Current

*Attorney, Agent, or Firm*—David Sadowski; M. Howard Silverstein

[57] ABSTRACT

Differential ginning is achieved by modifications to conventional saw-type ginning including, providing a saw gang including at least two saw sections each including at least one saw blade, conveying of material to be ginned (e.g. seed cotton) successively to each section, ginning of the material in each section so as to separate a portion of lint from the material, and separate removal of lint from each section. Thereby producing portions of lint, wherein the fiber qualities vary from portion to portion e.g. separating longer fibers from shorter fibers.

10 Claims, 2 Drawing Sheets

DIFFERENTIAL GINNING PROCESS AND APPARATUS

BACKGROUND OF THE INVENTION (1) Field of the Invention

This invention relates to improvements in ginning. More specifically the invention involves differential ginning by feeding at least a substantial portion of material to be ginned to a first section of a sectioned gin, conveying the material successively from section to section, and separately removing lint from each section of the gin.

(2) Description of the Prior Art

Removing the fibers from the cottonseed is referred to as ginning and the majority of cotton ginning performed in the U.S. today is accomplished by saw-type gin stands. The principle for saw-ginning has not changed appreciably since it was patented by Eli Whitney in 1794. Saw-ginning removes almost all of the fibers from the seed and these fibers are of varying length. Fiber length is determined genetically but can be influenced by weather, insects, nutrients, as well as the ginning process. It is widely known that fibers on cottonseeds are of various lengths and quality and that mechanically removing them results in the breakage of some of these fibers. However, a fiber length array of mechanically ginned cotton shows that there are still differences in the length of the ginned fibers. It is desirable to eliminate the breaking of fibers and to produce the longest possible fiber from the seed. It is also desirable to have the fibers to be of uniform length throughout the packaged bale.

Two previous inventors have obtained patents to remove fibers of different lengths (differential ginning) from seed cotton. U.S. Pat. No. 1,118,412 to J. W. Graves states that by subjecting seed cotton to different mechanical actions, fibers of different lengths and character are obtained. U.S. Pat. No. 1,862,884 to W. R. Collier states that when seed cotton is fed to the saw gang along a path parallel to the rotating axis of the saws, longer fibers are removed from the seed before the shorter fibers are removed. However, these two inventions are fairly radical in their principle and design. By contrast the present invention avoids such radical designs, and provides such differential ginning by means of readily performed modifications to conventional gins, such as the conventional gin shown in U.S. Pat. No. 2,744,293 to V. A. Johnson.

(3) Summary

It is the primary object of my invention to provide highly advantageous differential ginning by means of readily performed modifications to conventional ginning, while avoiding the radical designs of the differential ginning of the prior art. Clearly it is of great economic advantage to provide such differential ginning by modifying conventional ginning, rather than resorting to such radically different gin designs.

It is also an object of the invention to produce by such differential ginning separate portions of lint, the properties of the lint differing from portion to portion, as for example by including a first lint portion containing a relatively high proportion of long fibers, having fewer short fibers and having a lower coefficient of variation, then the other fiber portion(s).

I have surprisingly discovered that these and other objects may be accomplished by modifying a conventional saw type gin to: (1) convey material to be ginned successively to each of at least two saw sections for ginning in each saw section; (2) remove lint from each saw section; and (3) keep substantially separate the lint removed from each saw section, and thereby provide separate portions of lint.

DETAILED DESCRIPTION OF THE DRAWINGS

The improvements constituting the present invention may be incorporated into any saw type gin stand. However, for purposes of illustration only the drawins show said improvements incorporated into a gin stand generally of the tupe shown in U.S. Pat. No. 2,744,293 to V. A. Johnson (the principal components of the gin disclosed by Johnson being shown in the instant drawings).

Figure 3:
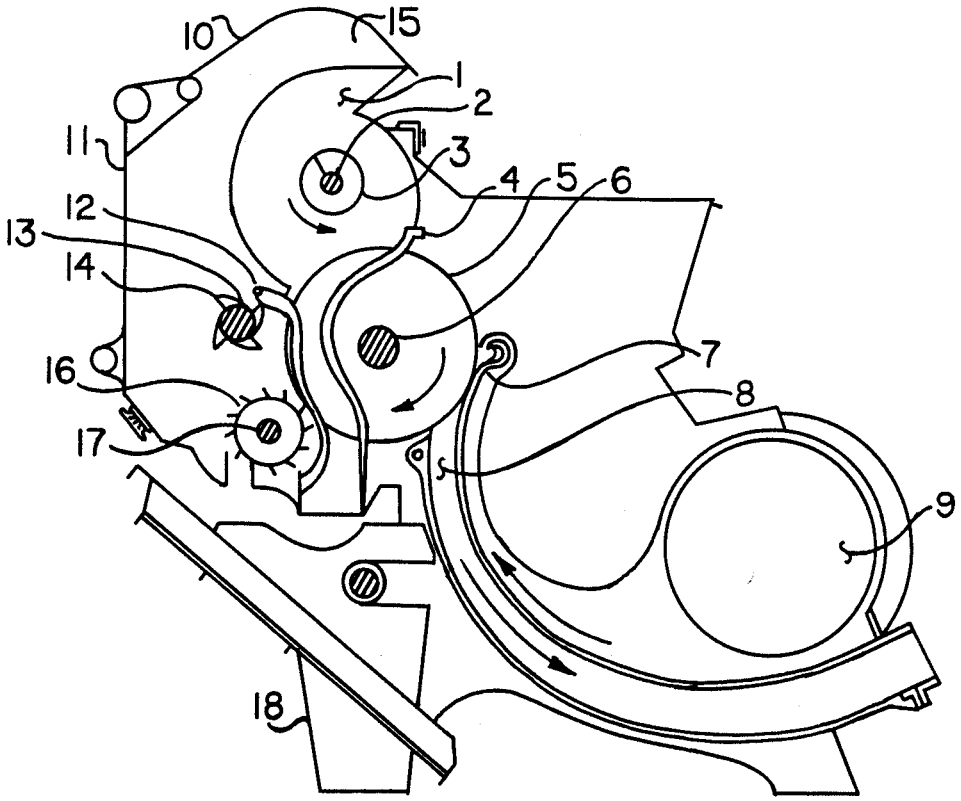
FIG. 3 is a view from the end of a gin stand as shown in either FIGS. 1 or 2, with the end of the housing removed.

The gin stand 10 may be constructed on a frame 18 and encased in a housing designated 1. Spaced circular ginning saws 5 (the saws collectively being referred to as a "saw gang") having teeth around their circumference, are mounted within roll box 1 on a central shaft 6 which is rotatably supported, as for example by bearings. The term "saw" is intended to encompass any generally disk shaped element having projections (including e.g. sharp teeth, conical projections, etc.) thereon capable of conveying lint between the ginning ribs. Ginning ribs 4 are disposed between the saws 5, and end ribs (not shown) are disposed adjacent the saws at each end of the saw gang, as for example by being attached to the interior of the housing immediately adjacent the ends of the saw gang. FIG. 3 also illustrates optional hulling components, i.e. huller ribs 12, a picker roll 14 on a rotatably mounted shaft 13, and spiker roller 16 on a rotatably mounted shaft 17. Seed cotton (e.g. either raw cotton or cotton from an extractor feeder or other primary cleaning device) may either: (1) be fed directly to roll box 1 or; (2) may be fed to an opening 15 in the housing 11 as shown in FIG. 3, and thereby fall in the front of the gin stand. The seed cotton is agitated and cleaned by the picker roll 14 which is rotated on a shaft designated 13. As the seed cotton falls, it is picked up by the spiked roller 16 (which is rotated on a shaft 17) and is presented to the ginning saws 5 at the huller ribs 12. The huller ribs 12 are interposed between the ginning saws and provide sufficient clearance for e.g. lint and seeds, but substantially prevent passage of hulls and large pieces of debris. Consequently, upon rotation of the saw gang, the ginning saw teeth pull material (e.g. lint and seeds) between the huller ribs 12 and into the roll box 1, while the hulls and larger debris retained by the huller ribs, drop from the gin. The ginning saw teeth also catch lint fibers in the roll box 1 and pull them through the ginning ribs 4 which provide more limited clearance with the saws so that no seeds may pass. Typically, the seeds remain in the roll box 1 until substantially all the lint is removed, at which time the seeds fall down between the huller ribs 12 and the ginning ribs 4, and drop from the gin. The lint is removed from the ginning saw teeth by doffing means, which is shown for purposes of illustration only, as including a high pressure gas (e.g. air) supply from plenum chamber 9 to nozzle 7. Alternatively, other conventional doffing means, such as a brush positioned adjacent the saw gang may also be utilized. The doffing means functions to transport the lint through the lint chamber 8 (defined by means defining a lint chamber adjacent the saw gang) to a lint flue where the lint may for example be conveyed to other cleaning apparatus or to baling devices.

A first aspect of the improvements constituting the present invention relates to the manner of feeding the material to be ginned to the gin. It is conventional practice to feed the material to be ginned to the entire width of the gin (i.e. feeding to the entire length of the roll box). However, the present invention contemplates feeding (either directly to the roll box 1, or first through opening 15 to the front of the gin and subsequently to the roll box) at least a substantial portion (or all) of the material to be ginned to a portion of the width of the gin e.g. in the area of the "feed zone" shown in FIGS. 1 and 2, which may for example be at one end of the gin. Thus for the embodiment shown in FIG. 1, at least a substantial portion (or all) of the material to be ginned may be directed to the first saw section, e.g. to the first half of the saws. The phrase "saw section" encompasses one or more saw blades, and may typically include for example 25 to 50 saw blades. Selection of the number of saw(s) in each section depending upon the desired rate of ginning e.g. use of a larger number of saws permits a higher rate of ginning. For the embodiment shown in FIG. 2, at least a substantial portion (or all) of the material to be ginned may be directed to the feed zone adjacent the left saw section e.g. to the first one third of the saws. The manner of feeding of the present invention may thus provide for an initial ginning at a first saw section which produces a first portion of lint. Typically the first portion of lint will contain a relatively high proportion of long fibers, have fewer short fibers and have a lower coefficient of variation, than the fiber portion(s) from the other saw section(s). Yarn produced from this first lint portion has higher yarn break factor and contains fewer Uster imperfections than yarn produced from fibers from a conventional gin stand.

Figure 1:
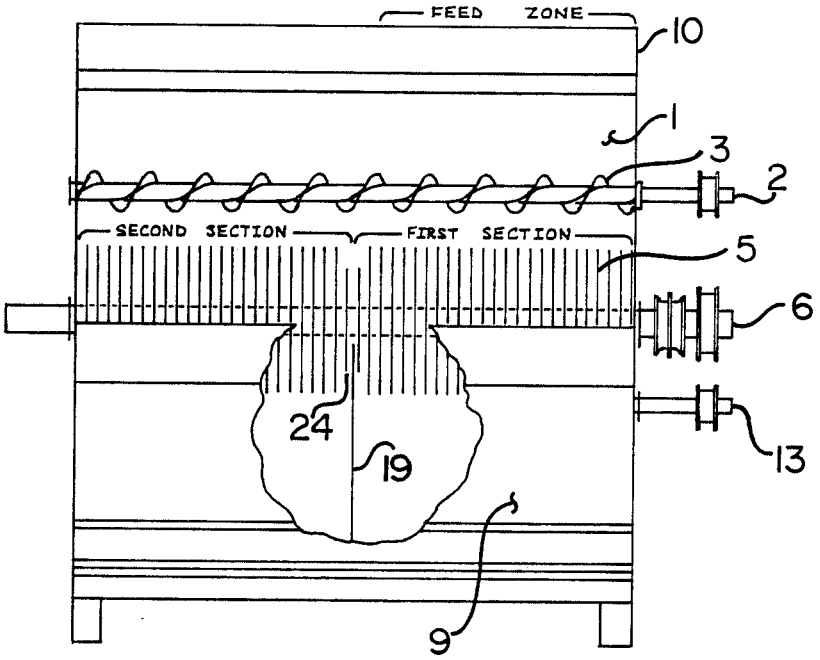
FIG. 1 illustrates a first embodiment of the invention, showing a partially cut-away rear view of a gin stand having two sections.
Figure 2:
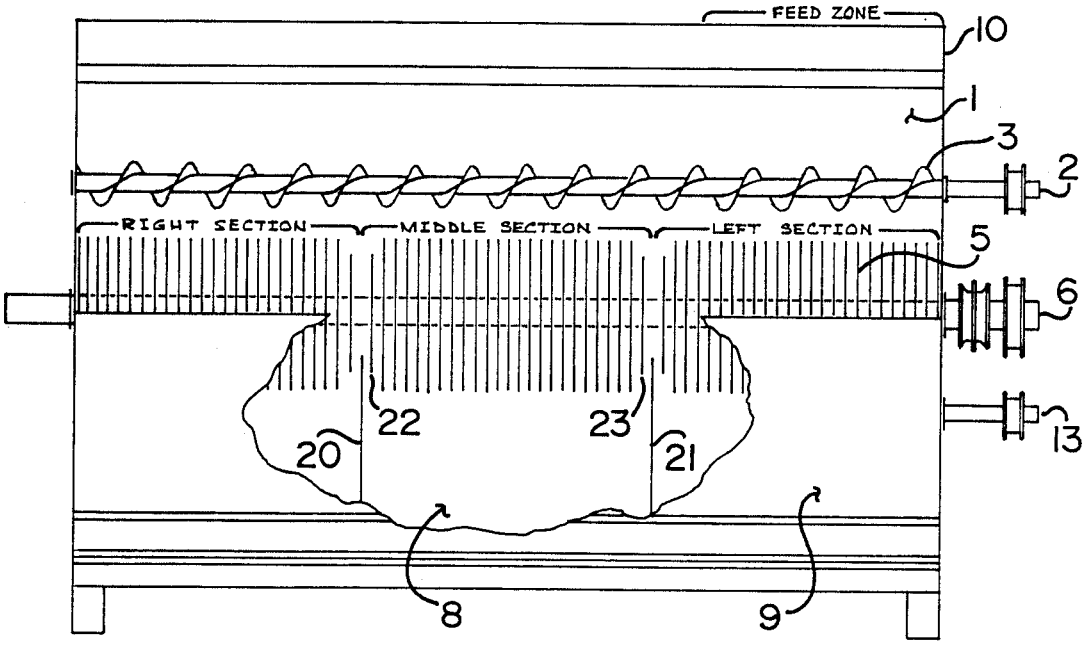
FIG. 2 illustrates a second embodiment of the invention, showing a partially cut-away rear view of a gin stand having three sections.

A second aspect of the improvements constituting the present invention relates to providing means for conveying the material to be ginned successively to each saw section e.g. along the width of the gin i.e. along the length of the roll box. For example, the conveying means may be provided within the roll box 1 for conveying material from a first saw section (e.g. from right to left as viewed in FIGS. 1 and 2) to a second saw section comprising one or more ginning saws e.g. one or more saws in a second section as shown in FIG. 1 or, one or more saws in a middle section as shown in FIG. 2. The conveying means is shown, for purposes of illustration only, as a helical auger 3 (rotated in a counter clockwise direction as viewed in FIG. 3 i.e. in the same direction of rotation as the seed roll to aid in the rotation of the seed roll) on a rotatably mounted shaft 2 approximately in the center of the roll box. The auger also functions to remove seeds by conveying them out an opening in the housing 11. Said second saw section or middle saw section, further gins the material and thereby produces a second portion of lint. Optionally, the material may then be conveyed to as many additional successively arranged saw sections as is desirable (e.g. one or more saws in the right section shown in FIG. 2) to produce a portion of lint from each said saw section. Optionally, the material may be conveyed along the entire length of the saw gang. Generally, the lint portion produced from each successive saw section will be of progressively shorter fiber length. The speed at which material is conveyed along the saws affects the separation of fibers in each saw section and consequently affects the qualities of the fibers separated in each section. The speed at which material is conveyed along the saw is adjusted in order to provide the desired fiber qualities from each section. For example, where the material is conveyed by the auger 3, adjustable drive means (such as a variable speed motor e.g. electric motor) may be utilized to facilitate adjustment of the rotational speed of the auger, and consequent adjustment of fiber qualities produced by each section e.g. to maintain distinct fiber qualities.

A third aspect of the improvements constituting the present invention relates to providing separating means to keep substantially separate the lint portions removed from each saw section. This may be accomplished by providing baffles (e.g. formed from sheet metal) designated 19 in FIG. 1, and 20 and 21 in FIG. 2, partitioning, the lint chamber 8. Said baffles extend along the lint chamber 8 and into close proximity to the outer edges of the ginning saws 5 i.e. extending between said at least two saw sections. Optionally, one or more blank saws (i.e. blades without saw teeth) may be provided between the saw sections (e.g. adjacent the baffle(s)), in order to provide a more distinct cut-off (i.e. greater resolution) between the fiber qualities of the various lint portions. FIG. 1 shows a pair of such blank saws designated 24. FIG. 2 shows, a first pair of blank saws designated 22, and a second pair of blank saws designated 23.

The various rotatably mounted shafts (e.g. 2, 6, 13 and 17) are driven in a conventional manner by suitble drive means, as for example by a belt(s) connecting a motor(s) to pulleys mounted on said shafts. Such pulleys being shown in the right hand portion of FIGS. 1 and 2.

EXAMPLE

A Model 49M Murray air-blast gin stand with 12-inch diameter saws was modified to accommodate a 3-inch auger with a pitch of 3 inches in the seed-roll box. A partition was placed in an extractor-feeder so that the gin stand was fed only over the first one-third of the saws. The seed cotton was continuously fed into the first one-third of the stand, partially ginned, and then moved the remaining length of the gin stand. As the seed cotton moves along the length of the stand (from right to left as viewed in FIG. 2), fibers are continuously removed with the longer fibers being removed first, and the shorter fibers coming off in the middle and right sections of the stand. These different fiber lengths were kept separated by a partitioned lint flue behind the gin stand. The 3-inch -diameter auger in the roll box was driven by a variable speed motor so that the length of time for the seed-cotton to travel from the left of the stand to the right could be varied. This is referred to as auger speed in this example.

The gin stand was operated using two cotton varieties and two auger speeds. All the seed cotton was subjected to the recommended seedcotton cleaning sequence for machine-picked cotton prior to ginning. The test was conducted as a split plot experiment with the auger speeds and varieties as the whole units and the three portions of the lint flue or gin stand (designated as left, middle, and right) as subunits. Data were analyzed as a split plot design initially, however, since error "A" and error "B" were not significantly different (P>0.25) the data were re-analyzed with the two errors combined. The test was replicated four times with each seedcotton lot weighing 100 pounds and requiring an average of about 5 minutes to gin. Seed cotton samples were taken at the extractor-feeder apron for moisture content determination and for ginning on a 7-inch-wide gin stand with 10-inch-diameter saws for use as a comparison. Lint samples were taken for lint mositure content, High Volume Instrument (HVI) classifications, seedcoat fragment counts and fiber length distribution measurements.-

The fibers ginned by the three sections of the modified stand were kept separate by the partitioned lint flue, and the fibers were of different length distributions. The amount of lint removed by each section was not determined for each test lot but approximately 50, 35, and 15% were ginned in the left, middle and right sections, respectively. During the experiment, seed cotton moisture ranged from 8.0 to 9.7%. The replication means for lint moisture was not significantly different and ranged from 5.9 to 6.9%. Since lint cleaning was not used on the samples composite grade, staple, color grade, reflectance, yellowness and trash code data are not indicated. Only those parameters measured by the HVI and Peyer Almeter were analyzed. Interactions between variety and other test variables were not significant. Results are shown in tables 1 and 2, and in FIG. 4.

The tables clearly show that lint from the left section of the differential gin was longer, stronger, contained fewer short fibers, had lower micronaire, and contained less waste, then lint produced by the other sections of the gin or produced by a conventional gin.

TABLE I

| Main effects | Means for HVI parameters: Micro naire | Strength, g/tex | UHM[3] length, inches | Uniformity ratio |
|---|---|---|---|---|
| Speed | | | | |
| 126 rpm | 4.5 | 26.6 | 1.07 | 79.6 |
| 264 rpm | 4.4 | 26.6 | 1.08 | 79.7 |
| Variety | | | | |
| DES 422 | 4.3B | 23.8B | 1.09A | 79.3B |

TABLE I-continued

| Main effects | Means for HVI parameters: Micro naire | Strength, g/tex | UHM[3] length, inches | Uniformity ratio |
|---|---|---|---|---|
| DPL 90 | 4.6A | 29.4A | 1.06B | 80.0A |
| Position | | | | |
| Left | 4.2z | 27.3x | 1.11x | 80.6x |
| Middle | 4.4y | 26.4y | 1.09y | 80.3x |
| Right | 4.9x | 26.1y | 1.02z | 78.1y |
| Comparison[2] | 4.3 | 26.8 | 1.10 | 81.3 |

Means in a column not followed by the same upper or lower case letter are significantly different at the 5% level of probability as judged by Duncan's Multiple Range Test.
[2]Average of three samples ginned on 7-inch laboratory gin.
[3]Upper half mean.

TABLE II

| Main effects | Means for fiber length distribution (Peyer Almeter method) and seedcoat fragment counts.: Mean length, inches | Coefficient of variation, % | Fibers less than ½ inch, % | Upper quartile, inches | Fibers less than ¼ inch, % | 2.5% span length, inches | Seedcoat fragments, No./g |
|---|---|---|---|---|---|---|---|
| Auger speed | | | | | | | |
| 126 rpm | 0.87b | 34.4 | 13.8 | 1.08b | 2.0 | 1.09b | 65.6 |
| 264 rpm | 0.89a | 33.7 | 12.5 | 1.10a | 1.9 | 1.11a | 71.7 |
| Variety | | | | | | | |
| DES 422 | 0.89 | 34.7A | 13.6 | 1.11A | 2.2A | 1.12A | 74.7 |
| DPL 90 | 0.87 | 33.4B | 12.7 | 1.08B | 1.6B | 1.09B | 62.5 |
| Position | | | | | | | |
| Left | 0.96x | 29.9z | 6.5z | 1.16x | 0.6z | 1.16x | 39.1y |
| Middle | 0.91y | 32.4y | 9.5y | 1.11y | 1.1y | 1.12y | 40.9y |
| Right | 0.76z | 39.8x | 23.5x | 1.00z | 4.1x | 1.03z | 125.8x |
| Comparison[2] | .91 | 31.2 | 9.4 | 1.12 | 1.1 | 1.12 | 37.7 |

Means in a column not followed by the same upper or lower case letter are significantly different at the 5% level of probability as judged by Duncan's Multiple Range Test.
[2]Average of three samples ginned on 7-inch laboratory gin.

Figure 4:
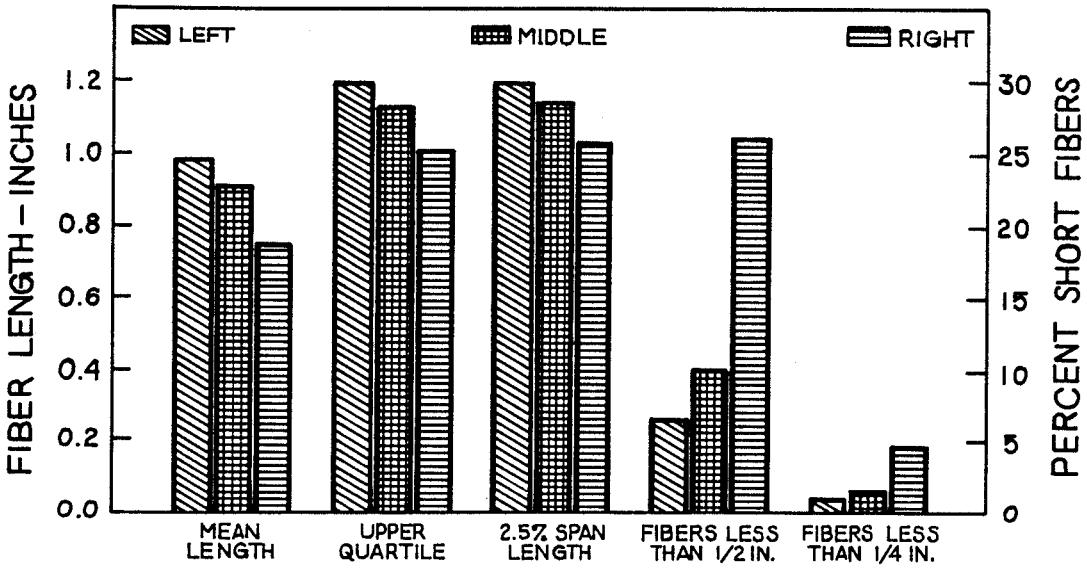
FIG. 4 is a bar graph showing results from an example of use of an embodiment of the present invention.

FIG. 4 graphically illustrates the differences in the length of fibers obtained from the modified gin stand. This graph depicts both the length of the long fibers as well as the percent short fibers in each fraction of the lint from the DES 422 cotton with an auger speed of 126 rpm.

INDEX OF APPARATUS ELEMENTS DESIGNATED BY A NUMERAL

| | | | |
|---|---|---|---|
| 1 | roll box | 13 | shaft |
| 2 | shaft | 14 | picker roll |
| 3 | auger | 15 | opening in housing |
| 4 | ginning ribs | 16 | spiked roller |
| 5 | ginning saws | 17 | shaft |
| 6 | shaft | 18 | frame |
| 7 | nozzle | 19 | baffle |
| 8 | lint chamber | 20 | baffle |
| 9 | plenum chamber | 21 | baffle |
| 10 | gin stand | 22 | blank saws |
| 11 | housing | 23 | blank saws |
| 12 | huller ribs | 24 | blank saws |

I claim:

1. An apparatus for ginning comprising, a saw gang including at lest two saw sections, each said saw section including at least one saw blade, support means rotatably supporting said saw gang, roll box means operatively associated with said saw gang for retaining material to be ginned in contact with said saw gang, conveying means operatively associated with said roll box means for conveying material to be ginned successively to each said saw section for ginning in each said saw section, means defining a lint chamber adjacent said saw gang, doffing means, operatively associated with said saw gang and said means defining a lint chamber, for removing lint from each said saw section and for transporting said lint through said lint chamber, and separating means, partitioning said lint chamber and extending between said at least two saw sections, operatively associated with said saw gang and doffing means for keeping substantially separate lint removed from each said saw section.

2. The apparatus of claim 1 wherein said doffing means includes, a gas nozzle adjacent said saw gang, and a source of gas connected to said nozzle.

3. The apparatus of claim 1 wherein said doffing means includes a brush rotatably mounted adjacent said saw gang.

4. The apparatus of claim 1 wherein said saw sections have positioned therebetween at least one blank saw.

5. The apparatus of claim 4 wherein said saw sections have positioned therebetween two blank saws.

6. The apparatus of claim 1 wherein said conveying means comprises an auger rotatably mounted within said roll box means.

7. The apparatus of claim 6 including means operatively associated with said auger for adjustably rotating said auger.

8. The apparatus of claim 7 wherein said means for adjustably rotating said auger includes a variable speed electric motor.

9. The apparatus of claim 1, wherein said roll box means defines a length extending along said saw gang, and further including feeding means operatively associated with said roll box means for feeding at least a substantial portion of material to be ginned to only a portion of said length of said roll box means adjacent a first of said saw sections.

10. The apparatus of claim 1 further including operatively associated means for dehulling said material to be ginned.

* * * * *